US005212497A

United States Patent [19]

Stanley et al.

[11] Patent Number: 5,212,497

[45] Date of Patent: May 18, 1993

[54] ARRAY JET VELOCITY NORMALIZATION

[75] Inventors: Douglas M. Stanley; Howard V. Goetz, both of Tigard, Oreg.

[73] Assignee: Tektronix, Inc., Wilsonville, Oreg.

[21] Appl. No.: 716,457

[22] Filed: Jun. 17, 1991

[51] Int. Cl.[5] ..... B41J 2/045

[52] U.S. Cl. ..... 346/1.1; 346/140 R; 310/317; 101/93.14

[58] Field of Search ..... 346/1.1, 75, 140 R; 310/317; 101/93.14

[56] References Cited

U.S. PATENT DOCUMENTS

| | | | |
|---|---|---|---|
| 3,872,788 | 3/1975 | Palombo | 101/93.14 |
| 4,126,867 | 11/1978 | Stevenson, Jr. | 346/140 R |
| 4,189,734 | 2/1980 | Kyser et al. | 346/1.1 |
| 4,282,535 | 8/1981 | Kern et al. | 346/140 R |
| 4,328,504 | 5/1982 | Weber et al. | 346/75 |
| 4,398,204 | 8/1983 | Dietrich et al. | 346/140 R |
| 4,563,689 | 1/1986 | Murakami et al. | 346/1.1 |
| 4,714,935 | 12/1987 | Yamamoto et al. | 346/140 R |

*Primary Examiner*—Benjamin R. Fuller
*Assistant Examiner*—Alrick Bobb
*Attorney, Agent, or Firm*—John D. Winkelman; Richard B. Preiss

[57] ABSTRACT

A multi-orifice ink jet print head array (32) includes multiple drive circuits that drive respective PZTs (16) to cause ink drops to be ejected from respective orifices (28). Each drive circuit includes a voltage divider (36) having a resistor $R_S$. The ink drop ejection velocity is controlled by selecting an appropriate value of $R_S$ for each voltage divider, thereby compensating for imperfections in manufacturing of the print head array. The value of a particular $R_S$ is selected by temporarily connecting the corresponding voltage divider (36A), in which the value of $R_S$ is $R_I$, to assessment circuit (56). The assessment circuit includes a potentiometer (66) with resistance value $R_{POT}$. Ink drops are ejected at a rapid periodic rate as a camera (102) records the position of the ink drops with respect to a graticule (94) at the time a strobe (100) flashes. The value of $R_{POT}$ is adjusted until the ink drops are on the graticule as viewed on a monitor (108), at which time $R_{POT}=R_T$. $R_S$ is then laser trimmed by an amount $R_T$, so that $R_S=R_F$, where $R_F=R_I+R_T$.

20 Claims, 4 Drawing Sheets

ARRAY JET VELOCITY NORMALIZATION

TECHNICAL FIELD

The present invention relates to a multi-orifice ink jet print head array which is tuned so that each orifice ejects ink drops at the same desired velocity.

BACKGROUND OF THE INVENTION

Ink jet printers eject ink onto a print medium, such as paper, in controlled patterns of closely spaced dots. FIG. 1 is a schematic view of a typical prior art multi-orifice ink jet print head array 10. Ink is supplied from a reservoir 12 to ink chamber 14A. A piezoceramic transducer (PZT) 16A is bonded to a diaphragm 18A, which constitutes a wall of chamber 14A.

PZT 16A contains electrodes that are connected to a conductor 20A and an electrical ground 22. Signal source 24 applies a voltage signal between conductor 20A and ground 22, thereby creating a voltage difference between the electrodes of PZT 16A. Applying a voltage to PZT 16A causes it to bend and thereby bend diaphragm 18A to change the pressure of the ink in chamber 14A. If the signal has certain well-known waveform characteristics, the diaphragm 18A bends such that the pressure causes an ink drop to be ejected from orifice 28A toward paper 30.

As used herein, the letter "A" following a symbol means that the element identified by the symbol is associated with orifice 28A. Ink drops are also ejected from orifices 28B, 28C, and 28D, which are associated with other respective conductors, PZTs, and chambers, which are not shown but are analogous to conductor 20A, PZT 16A, and chamber 14A.

To print dots on all portions of paper 30, print head array 10 is shuttled back and forth in the X direction, as shown in FIG. 1, as paper 30 is advanced in the Y direction. Because of dot travel time, print head array 10 ejects an ink drop from a particular orifice before it is aligned with the intended destination of the dot. If the velocity of an ink drop is different from what is expected, the ink drop will not strike the intended location on paper 30. The drop location error is emphasized because ink drops can be ejected while the head is traveling in both the positive and negative X directions.

Ideally, each print head will eject ink drops at a predetermined desired velocity. In practice, because of imperfections in manufacturing, there is an unacceptably large deviation between the actual velocities and a desired velocity of the ink drops. Moreover, the speeds of ink drops from some orifices are too high, while the speeds of ink drops from other orifices are too low. As a result of the inaccurate velocities, images printed on paper 30 have certain imperfections such as poorly aligned edges.

As used herein, velocity includes both speed and direction. The speed at which an ink drop is ejected affects both the vertical (e.g., because of gravity) and horizontal (e.g., because of movement of print head 10) position at which the ink drop strikes paper 30. The initial speed also affects the initial direction.

The deviation between the actual velocities and the desired velocity can be reduced by advanced manufacturing techniques. Nevertheless, even with the best known manufacturing techniques and conditions, a print head array will include a high percentage of chambers and orifices that eject ink drops at an unacceptably large deviation from the desired velocity.

There is, therefore, a need for an ink jet print head array in which all of the orifices eject ink drops at velocities within an acceptable velocity range.

SUMMARY OF THE INVENTION

An object of the invention is, therefore, to provide a method and system that tunes a print head so that all of the orifices eject ink drops at velocities within an acceptable velocity range.

Another object of the invention is to provide a method for producing a print head array that is field replaceable without need for subsequent adjustments.

Yet another object of the invention is to provide a method and system for producing print heads capable of producing high quality prints.

The present invention is directed to a system and method for ejecting ink drops at velocities that are substantially equal to a desired velocity from an orifice of an ink jet print head array. The method includes establishing a standard that represents a position of the print medium with respect to the orifice. A particular value of an electrical parameter of the drive circuit is determined such that when the drive circuit includes the parameter ink drops are ejected at substantially the desired voltage. The particular value of the parameter may be the final value of a first resistive element in the drive circuit or the value of resistance added in series with the first resistive element. A second resistive element is used to determine the particular value in a assessment circuit which applies particular amounts of voltage to a transducer to provide test ink drops in alignment with the standard at respective predetermined times following respective ejections of the test ink drops from the orifice. The drive circuit is modified based on the particular value of the parameter, so that thereafter ink drops are ejected from the orifice at substantially the desired velocity.

In a preferred embodiment, the drive circuit includes a voltage divider network between the driver and the PZT. A series resistor element, whose value is set by a laser cutting process, is used to set the desired ink drop ejection velocity. The amount to which the series resistor of the voltage divider is set is determined by the use of an assessment system that includes an electrically variable resistor, which is the second resistive element, connected in series with the voltage divider network. The sum of the values of the variable resistor and the voltage divider network determines the target value of the voltage divider series resistor to be set by the laser cutting process. Because laser cutting increases the resistance value, the initial value of the voltage divider series resistor is purposefully set low. The method may entail an iterative step.

The assessment system used for determining particular values of parameters of respective voltage divider circuits of the ink jet print head array includes a multiplexer for connecting a voltage varying circuit (including, for example, the variable resistor) to respective voltage dividers. The voltage of the input is varied until the ink drops are ejected at substantially the desired velocity. A resistance value associated with substantially the desired velocity is stored for future use.

Additional objects and advantages of the present invention will be apparent from the detailed description of preferred embodiments thereof, which proceeds with reference to the accompanying drawings.

DETAILED DESCRIPTION OF PREFERRED EMBODIMENT

Figure 1:
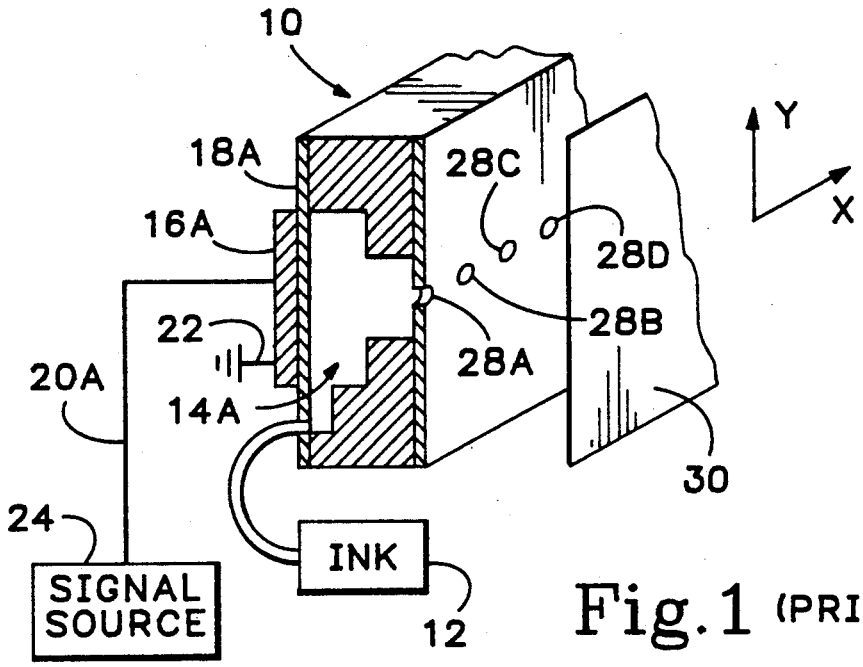
Fig. 1 (PRIOR ART)
FIG. 1 is a schematic fragmentary view of a prior art ink jet print head.
Figure 2:
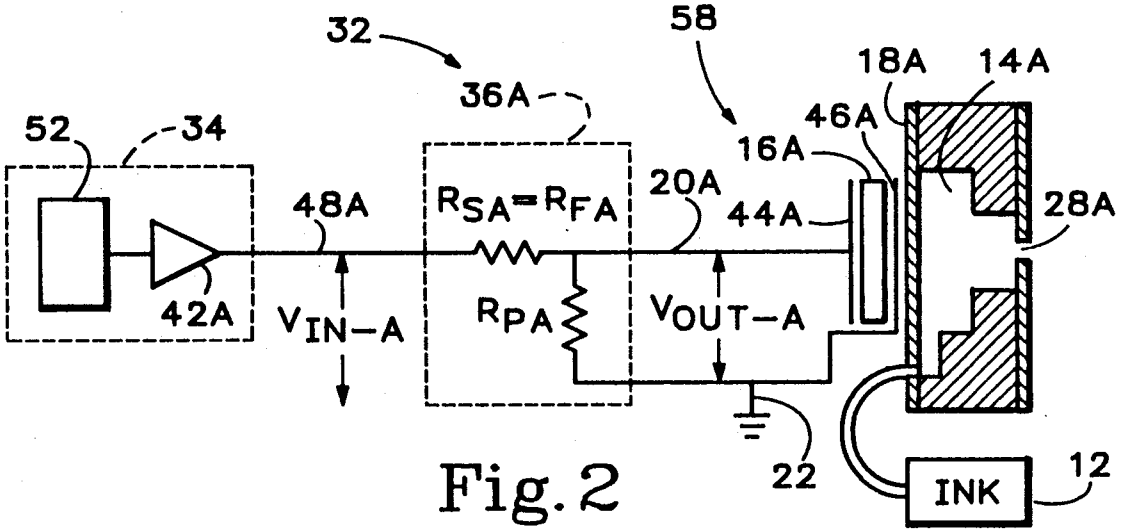
FIG. 2 is a schematic view of a print head array according to the present invention in which a voltage divider circuit is used in driving a PZT.

Referring to FIG. 2, multi-orifice ink jet print head array 32 comprises a voltage divider 36A positioned between a signal source 34 and an electrical conductor 20A. For clarity, the reference numbers used in identifying prior art print head array 10 are used in connection with the present invention. Signal source 34 may be identical to prior art signal source 24.

Signal source 34 comprises a voltage driver 42A that produces a signal on a conductor 48A for driving PZT 16A, which includes electrodes 44A and 46A. Voltage divider 36A comprises resistors $R_{SA}$ and $R_{PA}$. Resistor $R_{SA}$ is connected between conductor 48A and electrode 44A. Resistor $R_{PA}$ is connected between electrode 44A and ground 22.

An array controller 52 produces drive signals for driving each PZT 16 of print head array 36. Print head array 36 includes voltage drivers 42B, 42C, etc. (not shown), conductors 48B, 48C, etc. (not shown), voltage dividers 36B, 36C, etc. (not shown), PZTs 16B, 16C, etc. (not shown), chambers 14B, 14C, etc. (not shown), and orifices 28B, 28C, etc. (not shown), all of which are analogous to voltage driver 42A, voltage divider 36A, PZT 16A, chamber 14A, and orifice 28A, schematically illustrated in FIG. 2. The assembly of conductors 48A, 48B, etc., voltage dividers 36A, 36B, etc., transducers 16A, 16B, etc., chambers 14A, 14B, etc., and orifices 28A, 28B, etc., form a field replaceable unit (FRU) 58.

Voltage dividers 36B, 36C, etc. include resistors $R_{SB}$, $R_{SC}$, etc. (not shown), and $R_{PB}$, $R_{PC}$, etc. (not shown). The resistances of $R_{PA}$, $R_{PB}$, $R_{PC}$, etc., are each equal. However, for reasons explained below, the resistances of resistors $R_{SA}$, $R_{SB}$, $R_{SC}$, etc., may be changed through laser trimming by different amounts from initially equal values, $R_I$, such that the final operational values of resistors $R_{SA}$, $R_{SB}$, $R_{SC}$, etc., would probably not be equal. The values of resistors $R_{SA}$, $R_{SB}$, $R_{SC}$, etc., are set through a trimming process so that the voltages between electrodes 44A and 46A, 44B and 46B (of PZT 16B), and 44C and 46C (of PZT 16C), respectively, are such that ink drops are emitted at actual velocities that are substantially equal to a desired velocity. An actual velocity is substantially equal to a desired velocity if the actual velocity is within an acceptable velocity range whose span depends on the standards of a particular printer.

The velocity of the ink drops ejected from orifice 28A is strongly related to the voltage across PZT 16A. That voltage may be controlled with relatively high accuracy. Other factors that strongly influence the velocity of the ink drops are difficult to control. Such factors include the size of various portions of chamber 14A, the size of orifice 28A, the quality and alignment of PZT 16A, and the uniformity of the bond attaching PZT 16A to diaphragm 18A. A discovery of the present invention is that if the deviation in velocity caused by the other factors is within a certain range, then the adjustment of the voltage applied to PZT 16 by voltage divider 36A will change the velocity of ink drops ejected from orifice 28A to substantially a desired velocity. The velocity of successive ink drops from an orifice 28 is virtually constant as long as the various parameters of the print head do not change.

The signal present at conductor 48A has a voltage $V_{IN-A}$ with respect to ground 22. The signal at conductor 48A is not constant; therefore, $V_{IN-A}$ is not constant. Voltage $V_{OUT-A}$ is the voltage between electrodes 44A and 46A. Voltage divider 36A is a voltage divider between $V_{IN-A}$ and $V_{OUT-A}$, as defined in Equation (1), below.

$$V_{OUT-A} = V_{IN-A}(R_{PA}/(R_{SA} + R_{PA})) = V_{IN-A} R_{KA}. \quad (1)$$

Figure 3:
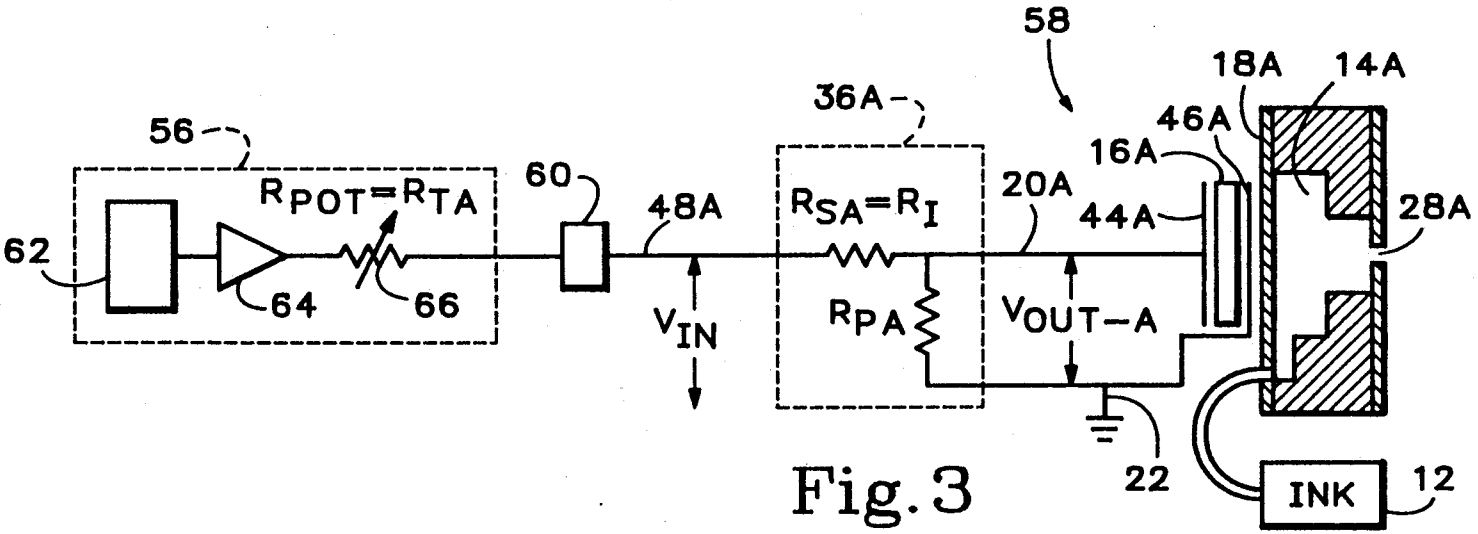
FIG. 3 is a schematic view of an assessment circuit used to determine the amount by which to trim resistor $R_{SA}$ of the voltage divider circuit of FIG. 2.

The procedure for determining and obtaining the correct value of $R_{KA}$ is described in connection with FIGS. 3-7. The value of $R_{PA}$ is not changed. The correct value of $R_{KA}$ is obtained by laser trimming $R_{SA}$ from its initial value of $R_{SA}=R_I$ to its final value of $R_{SA}=R_{FA}$. The proper value of $R_{FA}$ is determined as follows. Referring to FIG. 3, conductor 48A is connected to assessment circuit 56 by way of a multiplexer 60, which is described below in connection with FIG. 5.

Figure 4:
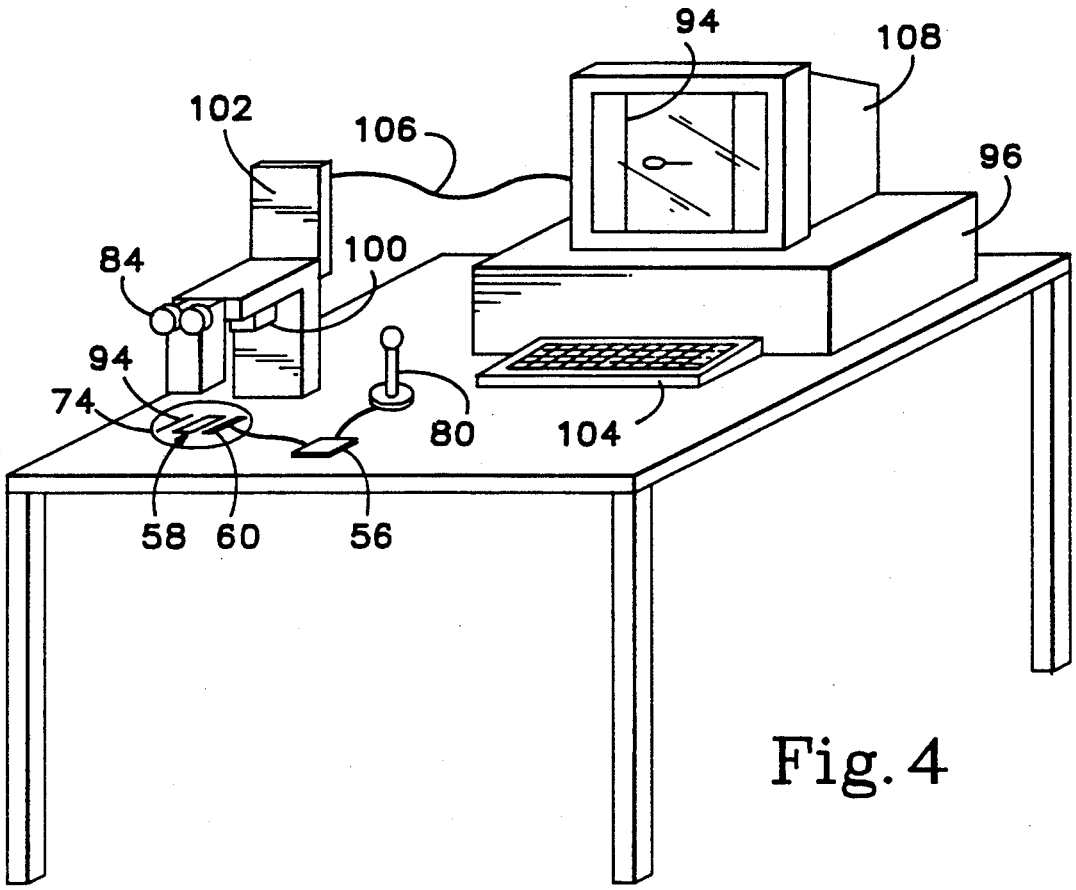
FIG. 4 is a pictorial view of an assessment system of which the assessment circuit of FIG. 3 is a part, and which is used to determine the amount by which to trim resistor $R_{SA}$ of the voltage divider circuit.
Figure 5:
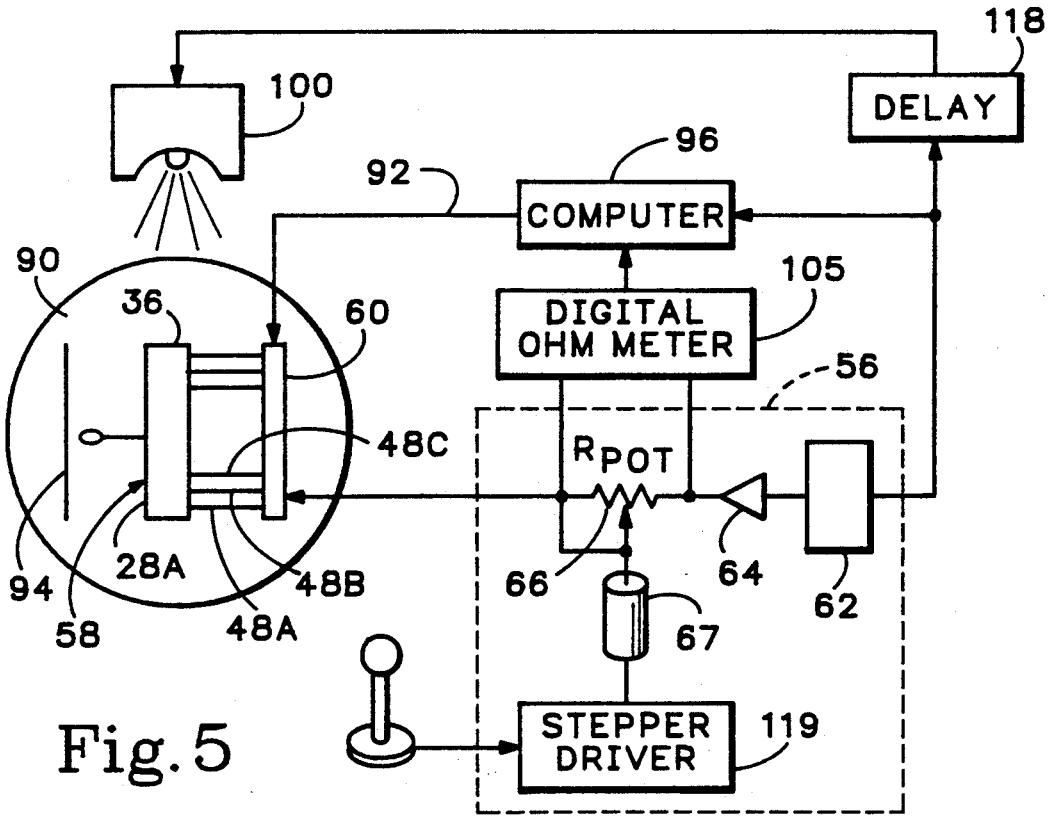
FIG. 5 is a block diagram of a portion of the system of FIG. 4.

Assessment circuit 56 includes a control circuit 62 (which may be identical to array controller 52), a voltage driver 64 (which should produce an output that is identical to the output of voltage driver 42A), and a stepper motor controlled potentiometer 66, depicted as a variable resistor in FIGS. 3 and 5. The resistance $R_{POT}$ of potentiometer 66 is varied between, e.g., 0 ohms and 5000 ohms by a stepper motor 67 which is controlled by a joystick 80, shown in FIGS. 4 and 5. Each step of the stepper motor changes the resistance of potentiometer 66 by about 6.6 ohms. Potentiometer 66 may be of the type marketed by Bourns, Inc., Riverside, Calif. as model number 82C2AE20BA0350.

Referring to FIG. 3, as the value of potentiometer 66 changes, the velocity of the ink drops ejected from orifice 28A changes within a velocity range. If the values of $R_{SA}$, $R_{PA}$, $R_{POT}$, and $V_{IN-A}$ are within certain ranges, described below, ink drops will be ejected from orifice 28A at substantially the desired velocity when the value of resistance $R_{POT}=R_{TA}$. After the value of $R_{TA}$ has been determined, resistor $R_{SA}$ is laser trimmed until the resistance of $R_{SA}=R_{FA}$, where $R_{FA}$ is defined in equation (2), below:

$$R_{FA}=R_I+R_{TA} \quad (2).$$

The procedure for determining when $R_{POT}=R_{TA}$ is described below in connection with FIGS. 3-6. Referring to FIG. 4, FRU 58 is electrically connected to assessment circuit 56 through multiplexer 60 and physically attached to XYZ table 74 under a microscope 84, supported on a table 76. Surface 90 of XYZ table 74 is shown in greater detail in FIG. 5. Multiplexer 60 receives the output of assessment circuit 56. Each of the conductors 48A, 48B, etc., is connected to a different output of multiplexer 60. The particular conductor 48 connected to assessment circuit 56 is selected by multiplexer 60 based on a control signal received on a conductor 92 from a computer 96. The control signal on conductor 92 directs multiplexer 60 to connect the output of assessment circuit 56 to successive ones of conductors 48.

Multiplexer 60 may include a logic-addressed analog switch, incremental stepper switch, relay matrix, or another analog switching means having a total of less than 20 picofarads of stray capacitance in the switch channel selected.

An example of the procedure for determining when $R_{POT}=R_{TA}$ is as follows. Multiplexer 6C first connects the output of assessment circuit 56 to conductor 48A until the proper value of $R_{TA}$ has been determined. The operator (not shown) then pushes a button(s) on a keyboard 104, and the value of $R_{TA}$ is measured by a digital ohm meter 105 such as a model DM-5010 manufactured by Tektronix, Inc., Beaverton, Oreg. The value of $R_{TA}$ is transmitted to the RAM of computer 96 or some other suitable memory by means of a conventional IEEE-488 instrumentation bus. Computer 96 sends a control signal on conductor 92 that causes multiplexer 60 to connect the output of assessment circuit 56 to conductor 48B. XYZ table 74 is moved so that the operator may view through microscope 84 the paths of the ink drops as they travel from orifice 48B. Viewing the ink drops also allows the operator to determine whether orifice 28A is functioning and whether the ink drops are correctly shaped.

Assessment circuit 56 remains connected to conductor 48B until $R_{TB}$ is determined. Then, the operator pushes a button(s) on keyboard 104 and the value of $R_{TB}$ is recorded in the RAM of computer 96 or some other suitable memory. Computer 96 sends a control signal on conductor 92, which signal causes multiplexer 60 to connect the output of assessment circuit 56 to conductor 48C, and so forth until the resistance value $R_T$ has been determined for each voltage divider 36 of print head array 32.

Computer 96 may be of the type marketed by AST Research, Irvine, Calif. under the name AST-386. Microscope 84 may be of the F-Series Trinocular type marketed by Nikon, Inc., Tokyo, Japan. XYZ table 74 may be of the type marketed by Daedal, Inc. Harrison City, Pa., as Series 10600.

Voltage $V_{IN}$ is supplied through multiplexer 60 to conductor 48A. Voltage divider 36A divides $V_{IN}$ to produce $V_{OUT-A}$ between electrodes 44A and 44B. As a result, an ink drop is ejected from orifice 28A. If the velocity is too low, the value of $R_{POT}$ is decreased. If the velocity is too high, the value of $R_{POT}$ is increased. The value of $R_{POT}$ is adjusted by stepper motor 67 under the control of joystick 80.

A preferred method of measuring the velocity of the ink drop is described as follows in connection with FIG. 5. A graticule 94 is produced at the location on a video monitor 108 representing where paper 30 would be located (e.g., 0.032 inches from orifices 28). Once every 125 microseconds, voltage driver 64 applies voltage $V_{IN}$, causing an ink drop to be ejected from orifice 28A. A strobe light 100 illuminates surface 90 at the time at which the ink drop should have reached graticule 94. Computer 96 controls the time at which circuit 62 produces an input signal to voltage driver 64, and by way of a 230 microsecond delay circuit 118, the time at which strobe light 100 illuminates surface 90. Strobe light 100 is fired 230 microseconds after each drop is ejected from the orifice.

The position of the ink drop at the time strobe 100 illuminates surface 90 is recorded by a camera 102 and displayed on monitor 108. A cable 106 connects camera 102 to monitor 108. Camera 102 may be of the type marketed by Cohu, Inc, San Diego, Calif., as model number 4815. Monitor 108 may be of the type marketed by Panasonic, Inc., Secaucus, N.J., as model number WV-5410. Strobe light 100 may be of the type marketed by E.G. & G. Electro-Optics, Huntington Beach, Calif., as model number MVS-2602.

Figure 6A:
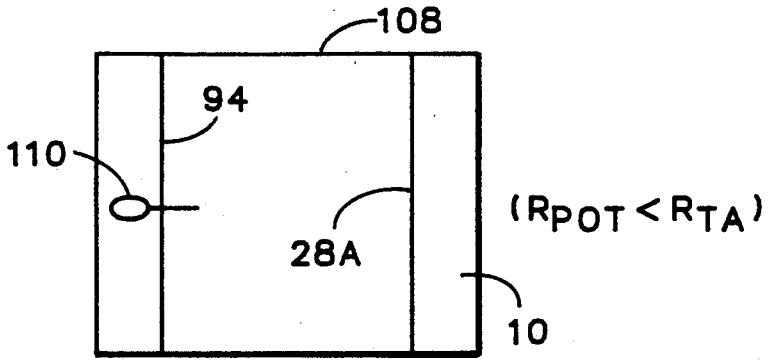
FIGS. 6A, 6B, and 6C are views of different ink drop positions, as shown on a monitor.
Figure 6B:
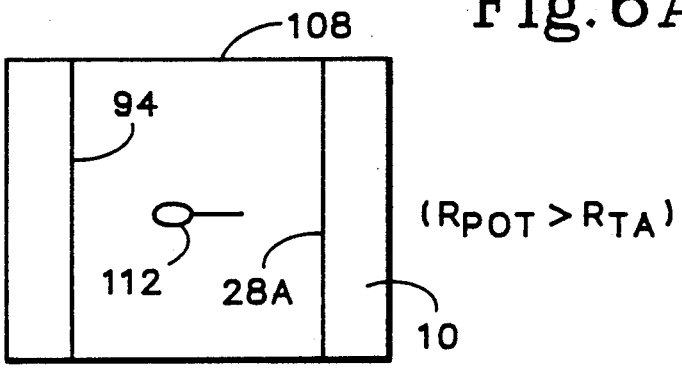
Figure 6C:
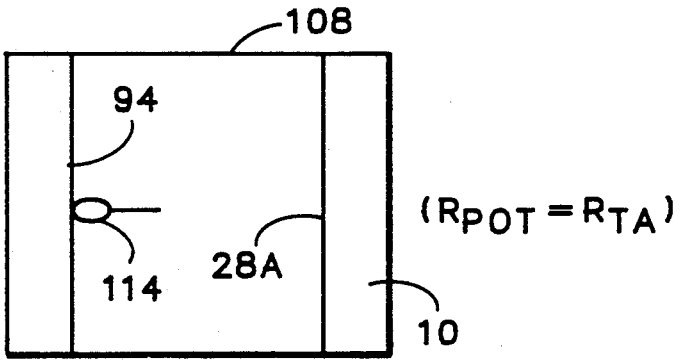

$V_{OUT}$ and, hence the position of the ink drop, changes as the value of $R_{POT}$ changes. The value of $R_{POT}$ equals $R_T$ when the ink drop reaches graticule 94 when strobe 100 illuminates surface 90. FIGS. 6A, 6B, and 6C illustrate the position of the ink drop on monitor 108 as a function of the value of $R_{POT}$. In FIG. 6A, the value of $R_{POT}<R_T$, and ink drop 110 has passed graticule 94 at the time strobe 100 illuminates surface 90. The operator then increases the value of $R_{POT}$. In FIG. 6B, the value of $R_{POT}>R_T$, and ink drop 112 has not reached graticule 94 at the time strobe 100 illuminates surface 90. The operator then decreases the value of $R_{POT}$. In FIG. 6C, the value of $R_{POT}=R_T$, and ink drop 114 has just reached graticule 94 at the time strobe 100 illuminates surface 90.

The ink drops are repeatedly ejected at a periodic rate so that the operator may observe on monitor 108 the positions of the ink drops at the times strobe 100 illuminates surface 90. The velocities of successive ink drops from an orifice 28 are virtually constant as long as the various parameters of the print head do not change. The operator uses joystick 80 to control stepper motor 67 that sets the resistance of potentiometer 66, by way of stepper driver electronics unit 119.

In a preferred embodiment, an acceptable range for the velocities of ink drops ejected from orifices 28A, 28B, 28C, etc. is from 3.36 meters per second (m/sec) to 3.73 m/sec, with 3.53 m/sec being preferred. The operator adjusts the value of $R_{POT}$ until the tip of the ink drop is as close as possible to graticule 94. The velocity at this rate will be within a desired velocity range (i.e., substantially equal to the desired velocity). Alternatively, more than one line could be drawn indicating the desired velocity range.

Computer 96 organizes the values of $R_{TA}$, $R_{TB}$, $R_{TC}$, etc., in a table with at least two columns, which values may be loaded onto a floppy disk or another transportable medium, such as a telephone line. The first column identifies the orifice with which resistor $R_S$ is associated. The second column identifies the value of $R_T$ by which the particular resistor $R_S$ to be trimmed. A single floppy disk may contain values of $R_F$ and resistors $R_S$ for more than one FRU 58. The floppy should also contain header information identifying the involved FRU(s) 58.

Signal source 34 can be produced with high accuracy so that the $V_{OUT}$ signal is very predictable. Therefore, each FRU 58 should be capable of ejecting ink drops at substantially the desired velocity regardless of which particular unit of signal source 34 FRU 58 is attached. In this regard, the procedure of the present invention is suited for large scale production of units of FRU 58. In practice, the values of $R_F$ may be obtained and resistors $R_S$ laser trimmed at different locations. In that case, with proper marking, the floppy and FRU(s) 58 can be matched up. After resistors $R_S$ of FRU 58 are trimmed, FRU 58 can be assembled into a printer at the same time and location on an assembly line, or at another time and location.

Once the values of $R_{TA}$, $R_{TB}$, $R_{TC}$, etc., have been determined for each $R_S$, the floppy disk is taken to an automated laser trimming machine 140 (shown in FIG. 7) which cuts $R_S$ according to a well-known technique until $R_S$ has the resistance value $R_F$, where $R_F=R_I+R_T$. Resistors $R_S$ and $R_P$ are standard passive elements of a thick film hybrid network. The circuitry of print head 36 is preferably integrated into a single hybrid circuit.

Figure 7:
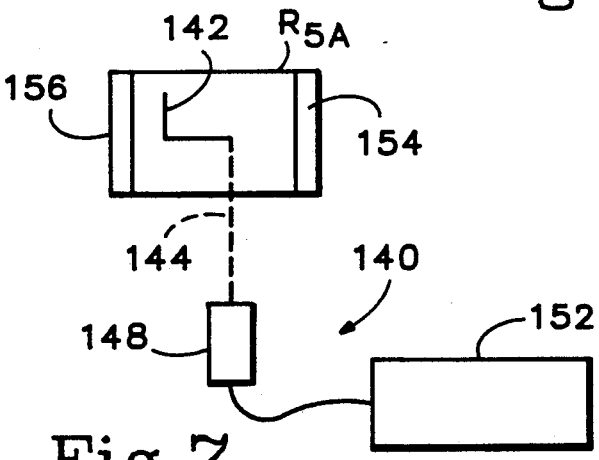
FIG. 7 shows an enlarged diagram of resistor $R_{SA}$ and the process by which it is laser trimmed.

Referring to FIG. 7, an L cut 142 is made to resistor $R_{SA}$ by a beam 144 from laser 148, which is preferably of the YAG type. The cut reduces the volume of a section of resistor $R_S$, thereby increasing the resistance. The cut does not have to be L-shaped. Conductive bands 154 and 156 are placed on the ends of resistor $R_{SA}$. Laser 148 is controlled by trimming machine controller 152. Trimming machine controller 152 receives the information of the columns identifying the orifice with which resistor $R_S$ is associated, and the value of $R_T$ by which the particular resistor $R_S$ is trimmed the floppy disk or other suitable means. Laser trimming machine 140, including controller 152 and laser 148, may be of the type marketed by Electro Scientific Industries (ESI), Portland, Oreg., as model 44.

The value of $R_P$ and the initial and final values of $R_S$ will depend on the typical range of values of the various parameters of print head array 32. In a preferred print head the initial value $R_I$ of $R_S$ is 6.17 Kohms $\pm 1\%$ and the value of $R_P$, which is not changed, is 5.56 Kohms $\pm 1\%$. The initial values of $R_S$ and the value of $R_P$ are chosen to produce predetermined rise and fall times for the drive signal applied to PZT 16A. The predetermined rise and fall times are primarily a function of the capacitance presented by PZT 16A, stray capacitances associated with assessment circuit 56, and stray capacitance of multiplexer 60.

Voltage driver 42A electronically switches two bi-polar voltages developed in array controller 52. The value of each voltage should be set so that $V_{IN}$ will be in a range such that some value of $R_{POT}$ will result in substantially the desired velocity. In this respect, the presence of voltage divider 36A may require that the voltages from voltage driver 42A be increased. Voltage driver 42A may comprise, for example, two field effect transistors joined to conductor 48A at their outputs. In the preferred embodiment the bi-polar voltage values are +85 volts DC and −74 volts DC.

In FIG. 2, signal source 34 is shown as consisting of array controller 52 and voltage driver 42A. There may be other circuits included as part of signal source 34. Indeed, some sort of voltage dividers may be used for other purposes such as controlling the rise and fall time of transitions in the drive signal applied to PZT 16A. In that case, the resistance values of resistors in another voltage dividers may be changed according to the procedure of the present invention rather than adding an additional voltage divider 36A.

As noted above, in a preferred embodiment, the distance from the orifices 28 to paper 30 is about 0.032 inches. The desired velocity is such that it would take an ink drop 230 microseconds ±12 microseconds to travel from an orifice 28 to paper 30. Typical values without divider 36 are between 160 and 240 microseconds. If the actual travel time of ink from a certain number of orifices is too large, e.g., 350 microseconds, or too small 180 microseconds, the print head array is rejected. Of course, the acceptable deviation and the number of unacceptable orifices will depend on the standards required by the printer.

The above-described addition of a voltage divider 36 in connection with all of the PZTs 16 and orifices 28 of print head array 32 contributes to predictable and consistent high print quality. A second benefit of the normalizing process of the present invention is that print head arrays 32 may be used that otherwise would be considered defective. Accordingly, yields are increased. This is particular significant considering that an entire print head array 32 may be considered defective if the velocity of ink drops from one orifice or a few orifices is unacceptable.

The present invention is not limited to a particular type of multi-orifice print head. An example of a preferred multi-orifice array is described in U.S. patent application Ser. No. 07/430,312, entitled "Drop-On-Demand Ink Jet Print Head" of Joy Roy and John Moore, filed Nov. 1, 1989, now abandoned and assigned to the assignee of the present application.

Many changes may be made in the above-described preferred embodiment of the present invention without departing from the underlying principles thereof. For example, PZT 16 may be replaced by another type of acousto-electric or magnetic transducer. In the preferred embodiment, resistors $R_{SA}$, $R_{SB}$, $R_{SC}$, etc. are trimmed, but resistors $R_{PA}$, $R_{PB}$, $R_{PC}$, etc., are not. Alternatively, resistors $R_{PA}$, $R_{PB}$, $R_{PC}$, etc., could be trimmed and resistors $R_{SA}$, $R_{SB}$, $R_{SC}$, etc., not be trimmed. In another alternative embodiment, both resistors $R_{SA}$, $R_{SB}$, $R_{SC}$, etc., and resistors $R_{PA}$, $R_{PB}$, $R_{PC}$, etc., could be trimmed such that the ink drops are ejected at substantially the desired velocity. Resistors $R_S$ and $R_P$ are not limited to passive elements.

In the preferred embodiment described above, resistor $R_S$ is laser trimmed so that $R_F=R_I+R_T$. Alternatively, a resistor of amount $R_T$ could be added in series with resistor $R_S$, which would remain at a resistance value $R_I$.

Signal source 34 may take many forms including digital-to-analog converters driven by a sequence of digital values clocked from a memory or a bank of conventional transistor switches connected to reference voltages in which each switch is controlled by drive signals derived from cascaded timer circuits.

The procedure for determining the proper setting of potentiometer 66 may be performed by automated means including position sensors or velocity detectors rather than by an operator.

It will be obvious to those having skill in the art that many other changes may be made in the above-described details of the preferred embodiment of the present invention without departing from the underlying principles thereof. The scope of the invention is, therefore, to be interpreted only by the following claims.

We claim:

1. A method for normalizing actual velocities of ink drops ejected from an orifice of an ink jet print head array such that the actual velocities are substantially equal to a desired velocity, the ink from which the drops are formed residing in a chamber and the print head array including a transducer that, in response to a drive signal developed by a drive circuit, produces pressure waves in the ink and thereby causes the ejection of the ink drops from the orifice toward a print medium at the actual velocities corresponding to the drive signal, the method comprising the steps of:

establishing a standard that represents a position of the print medium with respect to the orifice;

determining a particular value of a parameter of the drive circuit such that when an input signal is applied to the drive circuit including the parameter with the particular value, the ink drops are ejected from the orifice at substantially the desired velocity, the determining step occurring during a time when the drive circuit does not include the particular value of the parameter, and the determining step includes modifying a test input signal applied to a portion of the drive circuit such that the portion of the drive circuit applies to the transducer a test drive signal of a character that ejected test ink drops are in alignment with the standard at predetermined times following respective ejections of the test ink drops from the orifice; and modifying the drive circuit to include the particular value of the parameter, so that thereafter the ink drops are ejected from the orifice at substantially the desired velocity.

2. The method of claim 1 in which the portion of the drive circuit includes a first resistive element having a first resistance, and in which the determining step includes the step of introducing a second resistive element having a second resistance electrically connected to the first resistive element, the test input signal being modified by passing the test input signal through the second resistive element.

3. The method of claim 2 in which the particular value of the parameter is a final resistance of the first resistive element, and the step of modifying the drive circuit includes the step of adding resistance to the first resistive element by an amount equal to the second resistance such that the sum of the first and second resistances equals the final resistance of the first resistive element.

4. The method of claim 3 in which the step of adding resistance includes laser cutting the first resistive element.

5. The method of claim 2 in which the particular value of the parameter is an amount of resistance equal to the second resistance, and the step of modifying the drive circuit includes the step of adding resistance in series with the first resistive element by an amount equal to the second resistance.

6. The method of claim 1 in which the step of determining the particular value of the parameter includes an iterative process including the steps of:

introducing a second resistive element having a controllable second resistance, the second resistive element being electrically connected to a first resistive element, which is included in the portion of the drive circuit, and the test input signal being modified by passing the test input signal through the second resistive element;

setting the second resistance to a first value;

ejecting the test ink drops from the orifice;

determining a position of the test ink drops with respect to the standard at respective predetermined times following ejection of the test ink drops from the orifice; and setting the second resistance to a different value based on the determination of the position.

7. The method of claim 1 in which the standard is a graticule.

8. The method of claim 1 in which the step of determining the particular value includes displaying a video image of the standard and the test ink drops on a monitor and in which a strobe is illuminated at the predetermined times.

9. The method of claim 1 in which the particular value is stored in a transportable form.

10. A method for normalizing actual velocities of ink drops ejected from an orifice of an ink jet print head array such that the actual velocities are substantially equal to a desired velocity, the ink from which the drops are formed residing in a chamber and the print head array including a transducer that, in response to a drive signal developed by a drive circuit, produces pressure waves in the ink and thereby causes the ejection of the ink drops from the orifice toward a print medium at the actual velocities corresponding to the drive signal, the method comprising the steps of:

determining a particular value of a parameter of the drive circuit such that when an input signal is applied to the drive circuit including the parameter with the particular value, the drive circuit applies to the transducer the drive signal whose magnitude causes an ejection of the ink drops from the orifice at substantially the desired velocity; and modifying the drive circuit based on the particular value of the parameter so that thereafter the ink drops are ejected from the orifice at substantially the desired velocity.

11. The method of claim 10 in which the drive circuit includes a first resistive element having a first resistance, and in which the determining step includes the step of introducing a second resistive element having a second resistance electrically connected to the first resistive element and in which a test input signal applied to a portion of the drive circuit is modified by passing the test input signal through the second resistive element.

12. The method of claim 11 in which the particular value of the parameter is a final resistance of the first resistive element, and the step of modifying the drive circuit includes the step of adding resistance to the first resistive element by an amount equal to the second resistance such that the sum of the first and second resistances equals the final resistance of the first resistive element.

13. The method of claim 10 in which the step of determining the particular value of the parameter includes an iterative process including the steps of:

introducing a second resistive element having a controllable second resistance, the second resistive element being electrically connected to a first resistive element in the drive circuit and in which a test input signal applied to a portion of the drive circuit is modified by passing the test input signal through the second resistive element;

setting the second resistance to a first value;

ejecting the test ink drops from the orifice;

determining whether actual velocities of the test ink drops are less than, equal to, or greater than substantially the desired velocity; and setting of the value of the second resistance to a different value based on the determination of the actual velocities of the test ink drops.

14. The method of claim 10 in which the step of determining the particular value of the parameter further includes an iterative process including the steps of:

introducing a second resistive element having a controllable second resistance, the second resistive element being electrically connected to a first resistive element in the drive circuit and in which a test input signal applied to a portion of the drive circuit is modified by passing the test input signal through the second resistive element;

setting the second resistance to a first value;

ejecting the test ink drops from the orifice;

determining a position of the test ink drops with respect to a standard at respective predetermined times following the ejection of the test ink drops from the orifice; and setting the second resistance to a different value based on the determination of the position.

15. A system for determining parameter values of voltage divider circuits of an ink jet print head array, the print head array including transducers that produce pressure waves in ink residing in respective chambers to cause ejection of ink drops from respective orifices toward a print medium, the system comprising:

signal source means for producing an input signal;

voltage varying means for varying voltage of the input signal;

plural voltage dividing means receiving the varied input signal at respective inputs of the voltage dividing means for reducing the voltage of the varied input signal by respective amounts, each one of the voltage dividing means including an output that is connected to a respective one of the transducers;

multiplexing means for controllably connecting the voltage varying means to different respective ones of the inputs of the voltage dividing means; and memory means for recording values of a parameter of the voltage varying means for later use in altering respective values of a parameter of certain ones of the voltage dividing means.

16. The system of claim 15 in which the voltage varying means comprises a potentiometer.

17. The system of claim 15 further comprising video means for producing images on a monitor of respective groups of the ink drops.

18. A method for normalizing actual velocities of ink drops ejected from an orifice of an ink jet print head array such that the actual velocities are substantially equal to a desired velocity, the ink from which the drops are formed residing in a chamber and the print head array including a transducer that, in response to a drive signal developed by a drive circuit that includes a voltage divider circuit, produces pressure waves in the ink and thereby causes the ejection of the ink drops from the orifice toward a print medium at the actual velocities corresponding to the drive signal, the method comprising the steps of:

establishing a standard that represents a position of the print medium with respect to the orifice;

electrically coupling an input of the voltage divider circuit to a test driver circuit means including a variable resistive element having a variable resistance value for applying a test input signal to the input of the voltage divider circuit, the print head ejecting test ink drops from the orifice in response to the application of the test input signal;

determining relative positions of the test ink drops with respect to the standard at predetermined times following the ejections of the test ink drops;

adjusting the variable resistance value until one of the test drops is aligned with the standard at the predetermined time following the ejection of the one of the test ink drops; and adding an amount of resistance to the voltage divider circuit equal to the variable resistance value.

19. The method of claim 18 in which the variable resistive element is a potentiometer.

20. The method of claim 18 in which the voltage divider circuit is part of a field replaceable unit.

* * * * *